US011511539B2

(12) United States Patent
Ng et al.

(10) Patent No.: US 11,511,539 B2
(45) Date of Patent: Nov. 29, 2022

(54) MEMORIES OF FLUIDIC DIES

(71) Applicant: HEWLETT-PACKARD DEVELOPMENT COMPANY, L.P., Spring, TX (US)

(72) Inventors: Boon Bing Ng, Vancouver, WA (US); Erik D. Ness, Vancouver, WA (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 216 days.

(21) Appl. No.: 16/771,080

(22) PCT Filed: Feb. 6, 2019

(86) PCT No.: PCT/US2019/016780
§ 371 (c)(1),
(2) Date: Jun. 9, 2020

(87) PCT Pub. No.: WO2020/162910
PCT Pub. Date: Aug. 13, 2020

(65) Prior Publication Data

US 2021/0221124 A1 Jul. 22, 2021

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/04543; B41J 2/04546; B41J 2/04541; B41J 2/0458; B41J 2/04581; B41J 2/04586; B41J 2/1601; B41J 2/1607; B41J 2/1626
See application file for complete search history.

(56) References Cited

U.S. PATENT DOCUMENTS

| | | | | |
|---|---|---|---|---|
| 5,477,245 | A | 12/1995 | Fuse | |
| 5,646,672 | A | 7/1997 | Fukushima | |
| 5,801,980 | A | 9/1998 | Wong | |
| 5,917,509 | A * | 6/1999 | Becerra | B41J 2/04598 347/11 |
| 5,942,900 | A | 8/1999 | DeMeerleer | |
| 6,038,166 | A | 3/2000 | Wong | |
| 6,116,714 | A | 9/2000 | Imanaka et al. | |
| 6,161,916 | A | 12/2000 | Gibson et al. | |
| 6,398,332 | B1 | 6/2002 | Siiverbrook et al. | |
| 6,616,260 | B2 | 9/2003 | Skene et al. | |

(Continued)

FOREIGN PATENT DOCUMENTS

| | | |
|---|---|---|
| CN | 1292753 A | 4/2001 |
| CN | 1332412 | 1/2002 |

(Continued)

*Primary Examiner* — Thinh H Nguyen
(74) *Attorney, Agent, or Firm* — Trop Pruner & Hu, P.C.

(57) ABSTRACT

In some examples, a fluid dispensing device component includes a plurality of fluidic dies each comprising a memory, a plurality of control inputs to provide respective control information to respective fluidic dies of the plurality of fluidic dies, and a data bus connected to the plurality of fluidic dies, the data bus to provide data of the memories of the plurality of fluidic dies to an output of the fluid dispensing device component.

16 Claims, 5 Drawing Sheets

(56) References Cited

U.S. PATENT DOCUMENTS

| | | | |
|---|---|---|---|
| 6,866,359 | B2 | 3/2005 | Pan et al. |
| 7,267,417 | B2 | 9/2007 | Siiverbrook et al. |
| 7,506,961 | B2 | 3/2009 | Silverbrook |
| 7,510,255 | B2 | 3/2009 | Tamura et al. |
| 7,613,661 | B2 | 11/2009 | Nambudiri |
| 7,802,858 | B2 | 9/2010 | Kasai |
| 7,874,631 | B2 | 1/2011 | Sheahan et al. |
| 7,954,929 | B2 | 6/2011 | Edelen et al. |
| 8,064,266 | B2 | 11/2011 | Roohparvar |
| 8,474,943 | B2 | 7/2013 | Ness et al. |
| 8,561,910 | B2 | 10/2013 | Depaula et al. |
| 8,888,226 | B1 | 11/2014 | Gardner |
| 8,960,848 | B2 | 2/2015 | Yokouchi |
| 8,977,782 | B2 | 3/2015 | Miyasaka |
| 9,224,480 | B2 | 12/2015 | Grant et al. |
| 9,472,288 | B2 | 10/2016 | Gardner et al. |
| 9,493,002 | B2 | 11/2016 | Edelen et al. |
| 9,592,664 | B2 | 3/2017 | Ge et al. |
| 2002/0015066 | A1 | 2/2002 | Siwinski et al. |
| 2004/0017437 | A1 | 1/2004 | Yamaguchi |
| 2004/0239712 | A1 | 12/2004 | Liao et al. |
| 2005/0099458 | A1 | 5/2005 | Edelen |
| 2005/0140703 | A1 | 6/2005 | Ou |
| 2007/0194371 | A1 | 8/2007 | Benjamin |
| 2008/0049498 | A1 | 2/2008 | Werner |
| 2009/0040286 | A1 | 2/2009 | Tan et al. |
| 2009/0244132 | A1 | 10/2009 | Bruce |
| 2009/0251969 | A1 | 10/2009 | Roohparvar |
| 2010/0277527 | A1 | 11/2010 | Siiverbrook et al. |
| 2010/0302293 | A1 | 12/2010 | Torgerson et al. |
| 2011/0018951 | A1 | 1/2011 | Muraki et al. |
| 2012/0057408 | A1 | 3/2012 | Roohparvar et al. |
| 2013/0106930 | A1 | 5/2013 | Lea |
| 2015/0243362 | A1 | 8/2015 | Nigam |
| 2016/0009079 | A1 | 1/2016 | Clark et al. |
| 2016/0185123 | A1 | 6/2016 | Anderson et al. |
| 2016/0229179 | A1 | 8/2016 | Anderson |
| 2016/0250849 | A1 | 9/2016 | Sasaki |
| 2017/0028724 | A1 | 2/2017 | Edelen et al. |
| 2017/0069639 | A1 | 3/2017 | Ge et al. |
| 2017/0120590 | A1 | 5/2017 | Chen |
| 2017/0355188 | A1 | 12/2017 | Anderson et al. |
| 2018/0001618 | A1 | 1/2018 | Anderson et al. |
| 2018/0086122 | A1 | 3/2018 | Anderson |
| 2018/0154632 | A1 | 6/2018 | Chen et al. |
| 2018/0215147 | A1 | 8/2018 | Cumbie et al. |
| 2018/0345667 | A1 | 12/2018 | Edelen et al. |
| 2019/0016127 | A1 | 1/2019 | Linn |

FOREIGN PATENT DOCUMENTS

| | | | |
|---|---|---|---|
| CN | 1727186 | A | 2/2006 |
| CN | 1749980 | A | 3/2006 |
| CN | 1960875 | A | 5/2007 |
| CN | 101567362 | A | 10/2009 |
| CN | 101683788 | A | 3/2010 |
| CN | 101868356 | | 10/2010 |
| CN | 101983378 | A | 3/2011 |
| CN | 103619601 | A | 3/2014 |
| CN | 105280637 | A | 1/2016 |
| CN | 105636789 | A | 6/2016 |
| CN | 105873765 | A | 8/2016 |
| CN | 106685425 | A | 5/2017 |
| CN | 107073949 | A | 8/2017 |
| CN | 107111537 | A | 8/2017 |
| CN | 107206815 | A | 9/2017 |
| CN | 107428167 | A | 12/2017 |
| CN | 108886366 | A | 11/2018 |
| CN | 109922964 | A | 6/2019 |
| EP | 1170132 | A2 | 1/2002 |
| EP | 1054772 | B1 | 7/2003 |
| EP | 1232868 | B1 | 8/2006 |
| JP | 61-011845 | A | 1/1986 |
| JP | 08-127162 | A | 5/1996 |
| JP | 11-207948 | A | 8/1999 |
| JP | 2002-014870 | A | 1/2002 |
| JP | 2002-519808 | A | 7/2002 |
| JP | 2002-232113 | A | 8/2002 |
| JP | 2004-050637 | A | 2/2004 |
| JP | 2011-517006 | A | 5/2011 |
| JP | 2011-230374 | A | 11/2011 |
| JP | 2014-017049 | A | 1/2014 |
| JP | 2017-533126 | A | 11/2017 |
| KR | 20180005525 | A | 1/2018 |
| RU | 2579814 | C2 | 4/2016 |
| RU | 2635080 | C2 | 11/2017 |
| TW | 200631798 | A | 9/2006 |
| TW | 201637880 | A | 11/2016 |
| TW | 201637881 | A | 11/2016 |
| TW | 201813825 | A | 4/2018 |
| WO | 97/18953 | A1 | 5/1997 |
| WO | WO-2009064271 | A1 | 5/2009 |
| WO | WO-2013048430 | | 4/2013 |
| WO | WO-2014133534 | A1 | 9/2014 |
| WO | WO-2016068927 | A1 | 5/2016 |
| WO | WO-2017189009 | A1 | 11/2017 |
| WO | 2018/017066 | A1 | 1/2018 |
| WO | 2018/156617 | A2 | 8/2018 |
| WO | WO-2018143942 | A1 | 8/2018 |
| WO | WO-2018156171 | A1 | 8/2018 |
| WO | 2018/190864 | A1 | 10/2018 |
| WO | WO-2019009902 | A1 | 1/2019 |
| WO | WO-2019009904 | A1 | 1/2019 |

* cited by examiner

MEMORIES OF FLUIDIC DIES

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead devices that include fluidic actuators to cause dispensing of printing fluids.

BRIEF DESCRIPTION OF THE DRAWINGS

Some implementations of the present disclosure are described with respect to the following figures.

Figure 1:
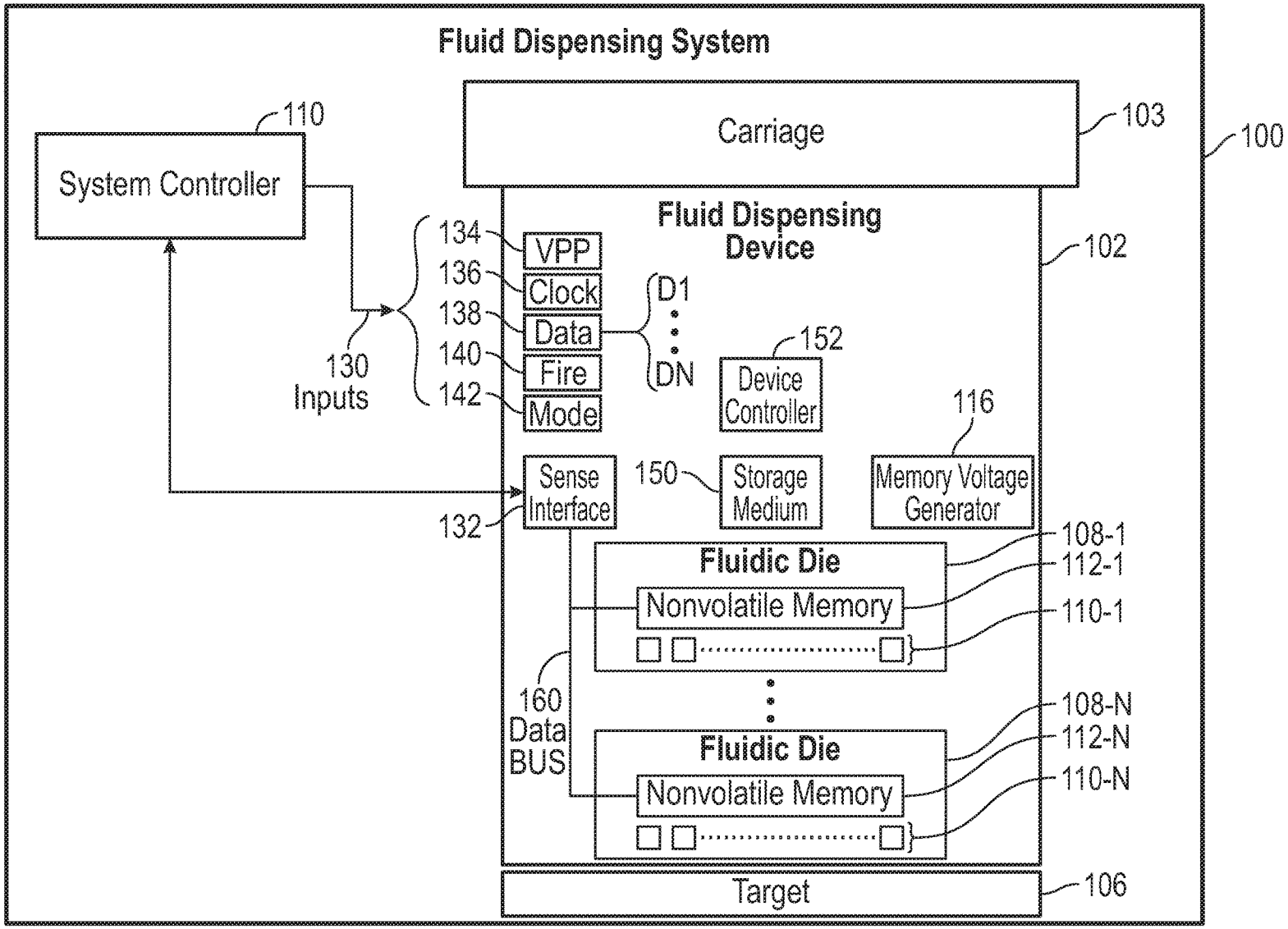
FIG. 1 is a block diagram of a fluid dispensing system according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing device can include fluidic actuators that when activated cause dispensing (e.g., ejection or other flow) of a fluid. For example, the dispensing of the fluid can include ejection of fluid droplets by activated fluidic actuators from respective nozzles of the fluid dispensing device. In other examples, an activated fluidic actuator (such as a pump) can cause fluid to flow through a fluid conduit or fluid chamber. Activating a fluidic actuator to dispense fluid can thus refer to activating the fluidic actuator to eject fluid from a nozzle or activating the fluidic actuator to cause a flow of fluid through a flow structure, such as a flow conduit, a fluid chamber, and so forth.

Activating a fluidic actuator can also be referred to as firing the fluidic actuator. In some examples, the fluidic actuators include thermal-based fluidic actuators including heating elements, such as resistive heaters. When a heating element is activated, the heating element produces heat that can cause vaporization of a fluid to cause nucleation of a vapor bubble (e.g., a steam bubble) proximate the thermal-based fluidic actuator that in turn causes dispensing of a quantity of fluid, such as ejection from an orifice of a nozzle or flow through a fluid conduit or fluid chamber. In other examples, a fluidic actuator may be a piezoelectric membrane based fluidic actuator that when activated applies a mechanical force to dispense a quantity of fluid.

In examples where a fluid dispensing device includes nozzles, each nozzle includes a fluid chamber, also referred to as a firing chamber. In addition, a nozzle can include an orifice through which fluid is dispensed, a fluidic actuator, and a sensor. Each fluid chamber provides the fluid to be dispensed by the respective nozzle.

Generally, a fluidic actuator can be an ejecting-type fluidic actuator to cause ejection of a fluid, such as through an orifice of a nozzle, or a non-ejecting-type fluidic actuator to cause flow of a fluid.

In some examples, a fluid dispensing device can be in the form of a printhead, which can be mounted to a print cartridge, a carriage, and so forth. In further examples, a fluid dispensing device can be in the form of a fluidic die. A "die" refers to an assembly where various layers are formed onto a substrate to fabricate circuitry, fluid chambers, and fluid conduits. Multiple fluidic dies can be mounted or attached to a support structure. In other examples, a fluid dispensing device can be in the form of a fluidic die sliver, which includes a thin substrate (e.g., having a thickness on the order of 650 micrometers (μm) or less) with a ratio of length to width (L/W) of at least three, for example. A die sliver can other dimensions in other examples. Multiple fluidic die slivers can be molded into a monolithic molding structure, for example.

In the present disclosure, a "fluid dispensing device component" can refer to either a fluid dispensing device, or a component that is part of, or attached to, or coupled to the fluid dispensing device.

A fluid dispensing device can include a nonvolatile memory to store data. A "nonvolatile memory" refers to a memory that is able to retain data stored in the memory even if power is removed from the memory. Examples of data that can be stored in the nonvolatile memory include identification information for the fluid dispensing device (e.g., a serial number or other identifier), device component characteristics (such as a brand name, color information, license information, etc.), fluid flow characteristics such as flow rate information, configuration information to configure the fluid dispensing device, security information used for secure access of the fluid dispensing device, and so forth. The data may be encrypted, scrambled, or encoded in any way.

In accordance with some implementations of the present disclosure, a fluid dispensing device includes multiple fluidic dies each including a respective memory (including a nonvolatile memory). To improve the efficiency of usage of the memories of the multiple fluidic dies, a first part of each memory can be used to store data specific to the corresponding fluidic die, and a second part of each memory can be used to store common data shared by the multiple fluidic dies. Also, the fluid dispensing device includes multiple control inputs that can provide control information to respective fluidic dies of the multiple fluidic dies. The fluid dispensing device includes a shared bus that is shared by the memories of the fluidic dies, so that data from the memories can be output from the fluid dispensing device.

FIG. 1 is a block diagram of a fluid dispensing system 100, according to some examples. The fluid dispending system 100 can be a printing system, such as a 2D printing system or a 3D printing system. In other examples, the fluid dispending system 100 can be a different type of fluid dispensing system. Examples of other types of fluid dispensing systems include those used in fluid sensing systems, medical systems, vehicles, fluid flow control systems, and so forth.

The fluid dispensing system 100 includes a fluid dispensing device 102, which can be mounted to a carriage 103 (or other type of support structure) of the fluid dispensing system 100. In some examples, the fluid dispensing device 102 can be attached to a fluid cartridge (e.g., a print cartridge) that is removably mounted to the carriage 103. In other examples, the fluid dispensing device 102 can be fixedly mounted to the carriage 103.

The fluid dispensing device 102 includes orifices for dispensing fluid towards a target 106. In some examples, the carriage 103 and the target 106 are moveable with respect to one another (either the carriage 103 is moveable or the target 106 is moveable or both the carriage 103 and the target 106 are moveable).

In a 2D printing system, the fluid dispensing device 102 includes a printhead that ejects printing fluid (e.g., ink) onto a print medium, such as a paper medium, a plastic medium, and so forth.

In a 3D printing system, the fluid dispensing device 102 includes a printhead that can eject any of various different liquid agents onto a print target, where the liquid agents can include any or some combination of the following: ink, an agent used to fuse or coalesce powders of a layer of build material, an agent to detail a layer of build material (such as by defining edges or shapes of the layer of build material), and so forth. In a 3D printing system, a 3D target is built by depositing successive layers of build material onto a build platform of the 3D printing system. Each layer of build material can be processed using the printing fluid from a printhead to form the desired shape, texture, and/or other characteristic of the layer of build material.

The fluid dispensing device 102 includes multiple fluidic dies 108-1 to 108-N (N≥2). The fluidic dies 108-1 to 108-N include respective arrays of fluidic actuators 110-1 to 110-N, and respective nonvolatile memories 112-1 to 112-N. For example, the fluidic die 108-1 includes the array of fluidic actuators 110-1 and the nonvolatile memory 112-1, and the fluidic die 108-N includes the array of fluidic actuators 110-N and the nonvolatile memory 112-N.

An array of fluidic actuators 110-*i* (i=1 to N) can include a column of fluidic actuators, or multiple columns of fluidic actuators. In some examples, the fluidic actuators 110-*i* can be organized into multiple primitives, where each primitive includes a specified number of fluidic actuators. The fluidic actuators 110-*i* can be part of nozzles or can be associated with other types of flow structures, such as fluid conduits, fluid chambers, and so forth. Each fluidic actuator is selected by a respective different address provided by a controller (e.g., a system controller 110) in the fluid dispensing system 100.

As used here, a "controller" can refer to a hardware processing circuit, which can include any or some combination of a microprocessor, a core of a multi-core microprocessor, a microcontroller, a programmable integrated circuit (e.g., application programmable integrated circuit (ASIC), etc.), a programmable gate array, a digital signal processor, a number of discrete hardware components (e.g., timers, counters, state machines, etc.), or another hardware processing circuit. A controller can also include discrete components such as timers, counters, state machines, latches, buffers, and so forth. Alternatively, a "controller" can refer to a combination of a hardware processing circuit and machine-readable instructions (software and/or firmware) executable on the hardware processing circuit.

Although FIG. 1 shows the system controller 110 as being one block, it is noted that the system controller 110 can actually represent multiple controllers that perform respective tasks. For example, the system controller 110 can be implemented using multiple ASICs, where one ASIC can be deployed on the carriage 103, and another ASIC can be a main ASIC for controlling fluid dispensing operations (e.g., printing operations).

The fluid dispensing device 102 includes various inputs 130, and a sense interface 132 (for inputting and outputting currents and voltages or data, for example). In an example, the sense interface 132 can receive an input current or input voltage, and can output a corresponding voltage or current. In other examples, other forms of input/output can be performed at the sense interface 132.

The inputs 130 include a programming voltage (referred to as "VPP") input 134 that provides an input voltage to the memory voltage generator 116. In some examples, the memory voltage generator 116 can include a converter to convert the input voltage VPP 134 to a programming voltage applied to perform programming of selected memory cells of a nonvolatile memory 112-*i* or multiple nonvolatile memories 112-*i*.

In other examples, the memory voltage generator 116 can be omitted, and the input voltage VPP 134 can be used for programming the memory cells of a nonvolatile memory.

The inputs 130 also include a clock input 136, which provides a clock signal that is provided to various circuitry in the fluid dispensing device 102. The inputs 130 also include a data input 138, to receive control data (e.g., in the form of a data packet) provided by the system controller 110. The data packet received at the data input 138 includes control information that can be used to control activation of selected fluid actuators 108. Also, as explained further below, the data packet can include information to set a mode of operation of the fluid dispensing device, where the mode of operation can include a fluidic operation mode for selective activation of fluidic actuators of the fluid dispensing device, or a memory access mode for writing or reading data of the nonvolatile memory.

As further examples, the control information included in a data packet received at the data input 138 from the system controller 110 includes primitive data and address data. Primitive data is provided in examples where the fluidic actuators 108 in the fluid dispensing device 102 are arranged in primitives. More generally, the primitive data can also be referred to as "fire data," which is data used to control activation or non-activation of a fluidic actuator (or fluidic actuators) within a primitive during the fluidic operation mode.

In examples where fluidic actuators 108-*i* are grouped into primitives, the primitive data can include corresponding bits to represent which of the fluidic actuators of a primitive is (are) activated when a fire pulse is delivered to the primitive. A fire pulse corresponds to a fire signal received at a fire input 140 being activated.

The address data includes address bits that define an address for selecting fluidic actuators 108-*i* to activate. In examples where fluidic actuators 108-*i* are grouped into primitives, each primitive includes a set of fluidic actuators, and the fluidic actuators of the primitive are selected by respective different addresses as represented by the address bits.

When the fluid dispensing device 102 is set in the memory access mode (e.g., memory write mode or memory read mode), the data packet received at the data input 138 can select memory cells of a nonvolatile memory to be written or read. Thus, the data input 138 is a control input shared by both the fluidic actuators and nonvolatile memory of a fluidic die for receiving respective control information for activating the fluidic actuators or access the nonvolatile memory, respectively.

The control information can also include other information that can be included into the data packet delivered by the system controller 110 to the fluid dispensing device 102.

The inputs 130 further include a mode input 142, which receives a mode signal that can be used as part of a sequence to set the fluid dispensing device 102 in a memory access mode.

In other examples, the inputs 130 of the fluid dispensing device 102 can include additional or alternative inputs.

The clock input 136, data input 138, fire input 140, and mode input 142 are examples of control inputs that provide control information to the fluid dispensing device 102.

The fluid dispensing device 102 also includes a data bus 160 to which the nonvolatile memories 112-1 to 112-N are coupled. Note that the nonvolatile memories 112-1 to 112-N can be connected directly to the data bus 160, or alternatively, intermediate circuitry can be provided in the respective fluidic dies 108-1 to 108-N to connect the nonvolatile memories 112-1 to 112-N to the data bus 160.

The data bus 160 is further connected to the sense interface 132. Thus, data read from the nonvolatile memories 112-1 to 112-N can be communicated over the data bus 160 to the sense interface 132, or output to the system controller 110.

As used here, the term "data" that is communicated over the data bus 160 can include analog signals (e.g., in the form of electrical currents or voltages) communicated over the data bus 160. In other examples, the data can refer to digital data.

In the arrangement shown in FIG. 1, the nonvolatile memories 112-1 to 112-N share a common data bus (160) that is coupled to an output (in the form of the sense interface 132) of the fluid dispensing device 102.

The data input 138 can include multiple subsets. For example, the data input 138 can be divided into multiple data input portions D1 to DN, where each data input portion Di (i=1 to N) is provided to a respective individual fluidic die 108-*i*. For example, the data input portion D1 is connected to the fluidic die 108-1 (but not to any other fluidic die including the fluidic die 108-N), and the data input portion DN is connected to the fluidic die 108-N (but not to any other fluidic die including the fluidic die 108-1). The data input portion D1 can receive a data packet provided to the fluidic die 108-1, and the data input portion DN can receive a data packet provided to the fluidic die 108-N. In some examples, each data input portion Di is made up of one bit. In other examples, each data input portion Di can be made up of multiple bits.

In some examples, the data bus 160 can be shared for communicating data of multiple nonvolatile memories 112-1 to 112-N of multiple fluidic dies 108-1 to 108-N, while individual control inputs (in the form of D1 to DN) are provided to respective individual fluidic dies 108-1 to 108-N. The clock input 136, the fire input 140, and the mode input 142 are control inputs that are shared by the multiple fluidic dies 108-1 to 108-N.

The fluid dispensing device 102 further includes a storage medium 150, which can be in the form of registers or latches, to store data packets received at corresponding data input portions D1 to DN of the data input 138. In some examples, the storage medium 150 can include shift registers. Each shift register serially input bits of a data packet received at respective data input portion Di into the shift register on successive activations of a clock signal received at the clock input 136. In other examples, the storage medium 150 can include registers each being able to load all bits of a data packet at one time into the register.

In further examples, the storage medium 150 can include shift registers and latches, where after a data packet is shifted into a shift register, the content of the shift register can be provided to the corresponding latch for storage. A "latch" can refer to a storage element for buffering data.

The fluid dispensing device 102 further includes a device controller 152 that is part of the fluid dispensing device 102. The device controller 152 can perform various operations of the fluid dispensing device 102, such as setting a mode of the fluid dispensing device 102, controlling activation of selected fluidic actuators 108, controlling writing or reading of the nonvolatile memory 112, and so forth.

The device controller 152 can be in the form of an ASIC, a programmable gate array, a microcontroller, a microprocessor, and so forth, or can be in the form of discrete components that cooperate to perform control tasks.

FIG. 1 shows the inputs 130 and the sense interface 132 of the fluid dispensing device 102 being coupled to the system controller 110. In some examples, the carriage 103 includes an electrical interconnect that can connect to the inputs 130 and the sense interface 132 when the fluid dispensing device 102 is attached to the carriage 130. The system controller 110 is in turn connected to the carriage 103, such as over a bus or another link.

Figure 2:
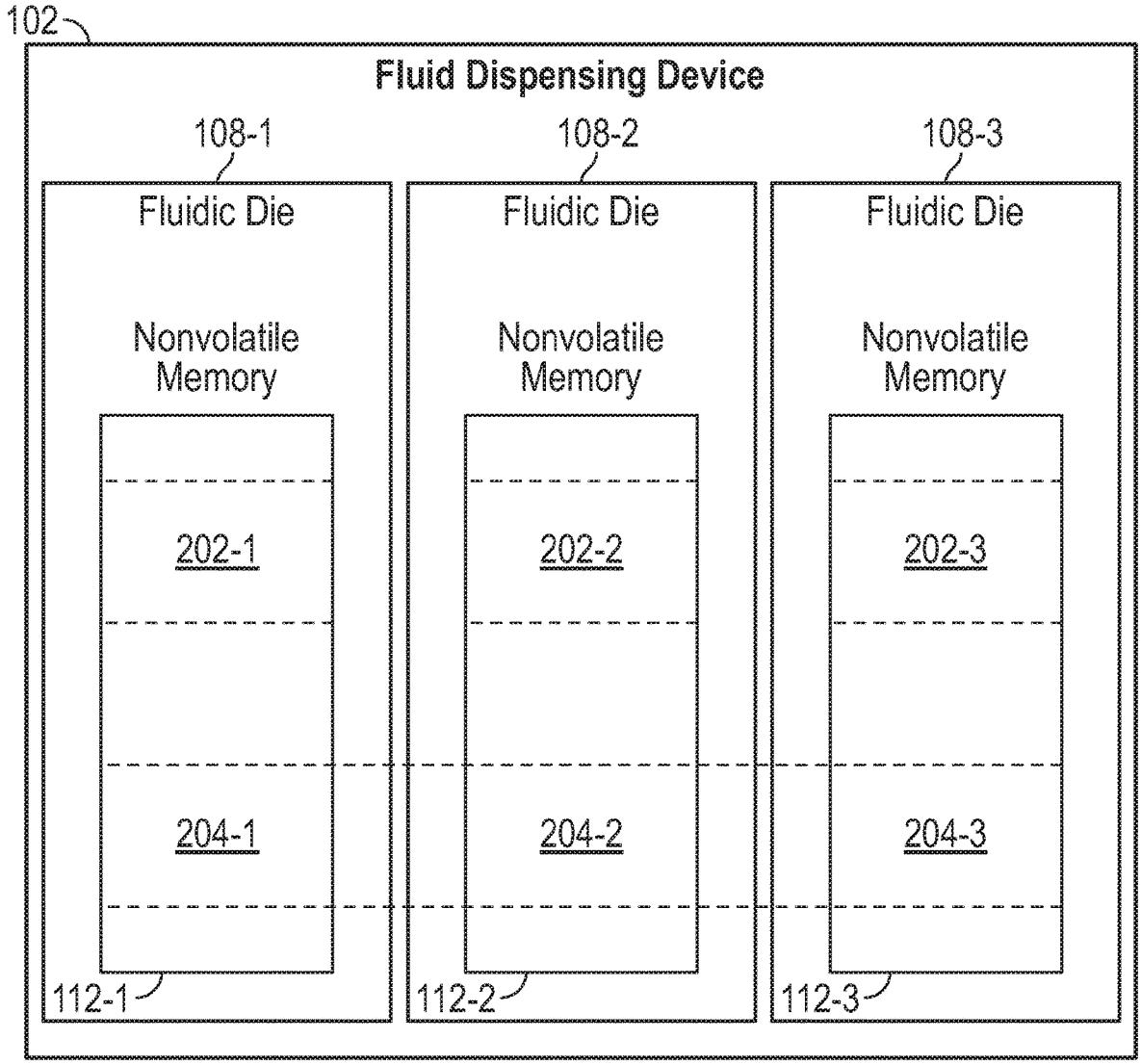
FIG. 2 is a block diagram of an arrangement of fluidic dies with respective memories, according to some examples.

FIG. 2 is a block diagram of an example arrangement in which three fluidic dies 108-1, 108-2, and 108-3 are provided on the fluidic dispensing device 102. Although a specific number of fluidic dies are shown in FIG. 2, in other examples, a different number of fluidic dies can be used.

The fluidic dies 108-1 to 108-3 include respective nonvolatile memories 110-1 to 110-3. Each nonvolatile memory can be divided into a first region for storing die-specific information, and a second region for storing shared information (also referred to as common information). For example, the nonvolatile memory 110-1 is divided into a die-specific region 202-1, and a shared region 204-1. Similarly, the nonvolatile memory 110-2 is divided into a die-specific region 202-2 and a shared region 204-2, and the nonvolatile memory 110-3 is divided into a die-specific region 202-3 and a shared region 204-3. In further examples, each nonvolatile memory can be divided into more than two separate regions.

Each die-specific region 202-1, 202-2, or 202-3 stores information that is specific to the corresponding fluidic die 108-1, 108-2, or 108-3. Examples of die-specific information can include wafer lot information relating to a wafer on which the fluidic die was formed, a manufacturing date of the fluidic die, and so forth.

Common information can be stored in the shared regions 204-1, 204-2, and 204-3. The common information pertains to the fluid dispensing device 102. For example, the common information can include information of a geographic region where the fluid dispensing device 102 is to be used, a generation of the fluid dispensing device 102, information tracking a fluid level of the fluid dispensing device 102 (e.g., the ink level of a print cartridge), and so forth. The common information can be stored in a distributed manner across the shared regions 204-1, 204-2, and 204-3.

Figure 3:
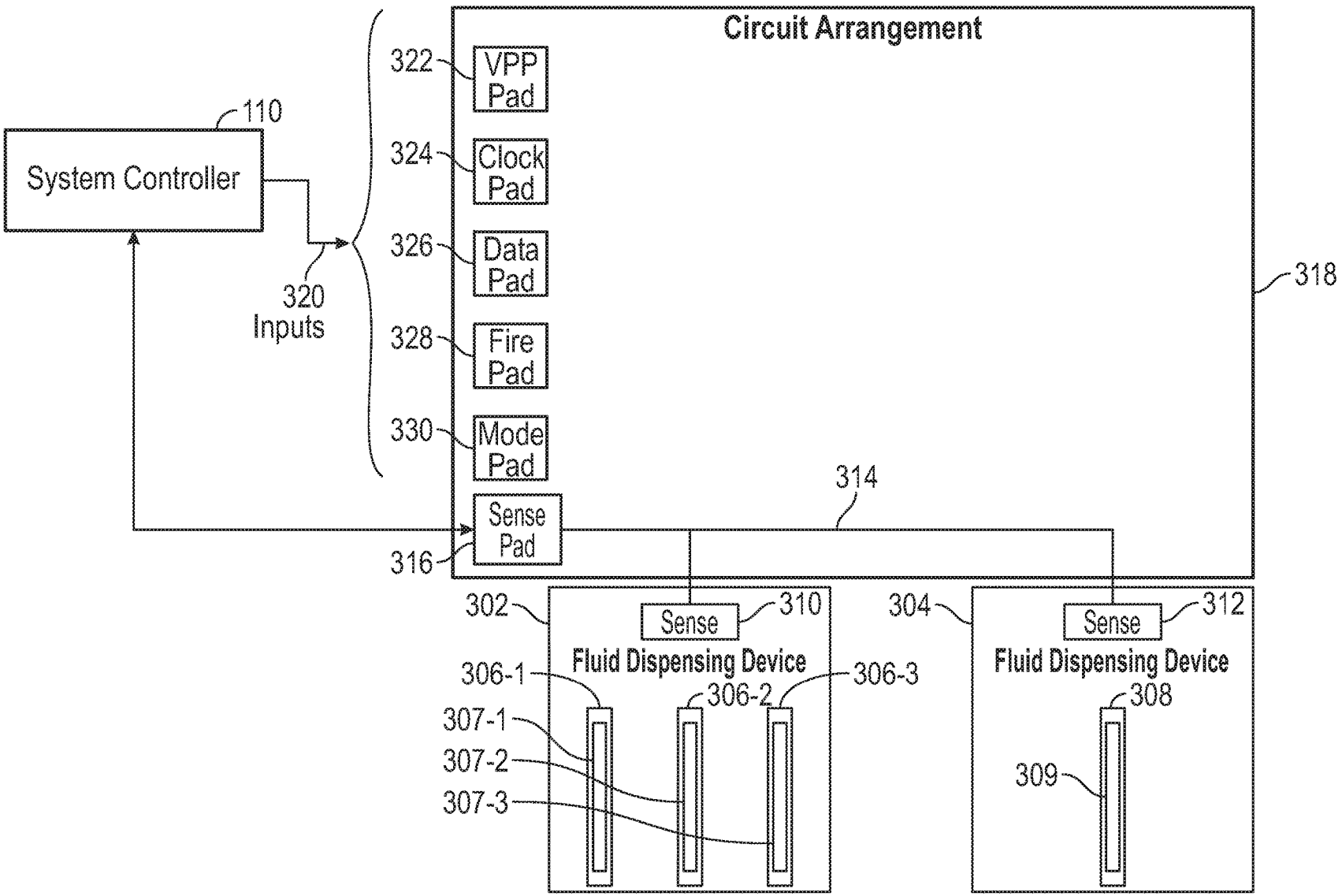
FIG. 3 is a block diagram of an arrangement that includes multiple fluid dispensing devices with corresponding fluidic dies including memories, according to further examples.

FIG. 3 is a block diagram of an example arrangement that includes multiple fluid dispensing devices 302 and 304. For example, the fluid dispensing devices 302 and 304 can include respective printhead assemblies, such as print cartridges. The fluid dispensing device 302 can include fluidic dies 306-1, 306-2, and 306-3, such as fluidic dies for dispensing inks of different colors, in some examples. The fluid dispensing device 304 can include a fluidic die 308, such as a fluidic die for dispensing ink of a different color, such as black. Although the fluid dispensing devices 302 and 304 show respective specific numbers of fluidic dies, in other examples, different numbers of fluidic dies can be included in the corresponding fluid dispensing devices 302 and 304. Moreover, more than two fluid dispensing devices can be provided.

The fluidic dies 306-1, 306-2, 306-3, and 308 include respective nonvolatile memories 307-1, 307-2, 307-3, and 309.

The fluid dispensing device 302 includes a sense interface 310, and the fluid dispensing device 304 includes a sense interface 312. The sense interfaces 310 and 312 are coupled over a global bus 314 to a sense pad 316. The sense pad 316 is connected to the system controller 110. Data read from the nonvolatile memories 307-1, 307-2, 307-3, and 309 can be output by respective sense interfaces 310 and 312 to the global bus 314, which in turn provides the data to the sense pad 316.

For example, the global sense interface and the global bus 314 can be part of a circuit arrangement 318 (e.g., a printed circuit arrangement) on the carriage 103 shown in FIG. 1.

The circuit arrangement 318 can also include other inputs 320, including a VPP pad 322, a clock pad 324, a data pad 326, a fire pad 328, and a mode pad 330. The VPP pad 322 can provide a programming voltage (VPP) to VPP inputs of the fluid dispensing devices 302 and 304. The clock pad 324 can provide a clock signal to the clock inputs of the fluid dispensing devices 302 and 304. The data pad 326 can provide control information (data packets) to the data inputs of the fluid dispensing devices 302 and 304. Note that the data pad 326 can provide respective data portions to corresponding data input portions (e.g., D1 to DN shown in FIG. 1) to each fluid dispensing device 302 or 304. Thus, while the fluidic dies 306-1, 306-2, 306-3, and 308 share the global bus 314, the fluidic dies 306-1, 306-2, 306-3, and 308 receive individual control information from the data portions of the data pad 326.

The fire pad 328 provides a fire signal to the fire inputs of the fluid dispensing devices 302 and 304. The mode pad 330 provides a mode signal to the mode inputs of the fluid dispensing devices 302 and 304.

Figure 4:
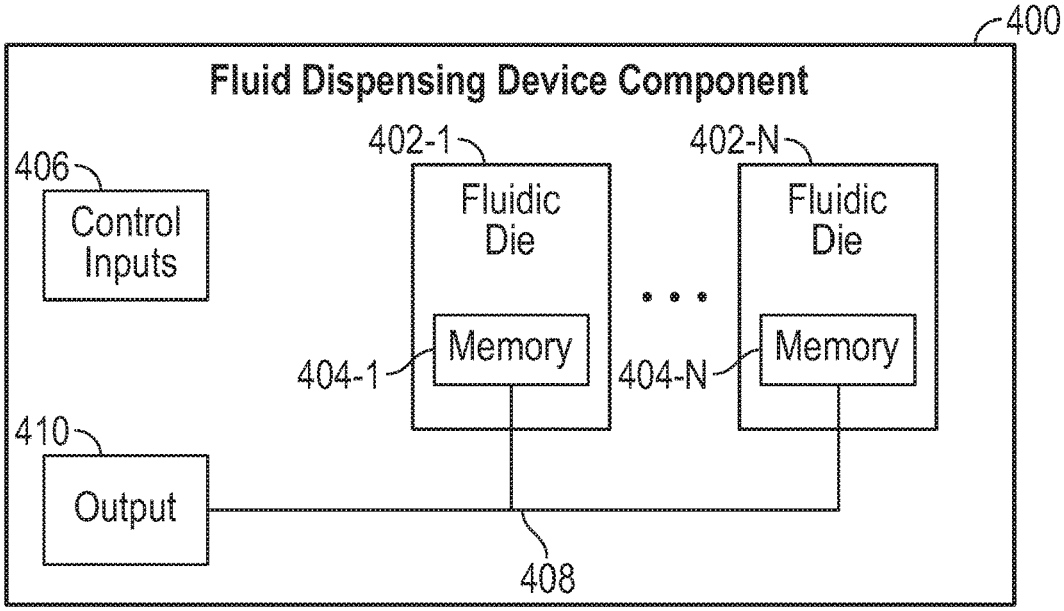
FIG. 4 is a block diagram of a fluid dispensing device component according to some examples.

FIG. 4 is a block diagram of a fluid dispensing device component 400 that includes multiple fluidic dies 400-1 to 400-N (N≥2). Each fluidic die 400-*i* (i=1 to N) includes a respective memory 404-*i* (404-1 to 404-N shown in FIG. 1).

The fluid dispensing device component 400 includes multiple control inputs 406 to provide respective control information to respective fluidic dies 402-1 to 402-N.

A data bus 408 is connected to the fluidic dies 402-1 to 402-N. The data bus 408 provides data of the memories 404-1 to 404-N of the fluidic dies 402-1 to 402-N to an output 410 of the fluid dispensing device component 400.

Figure 5:
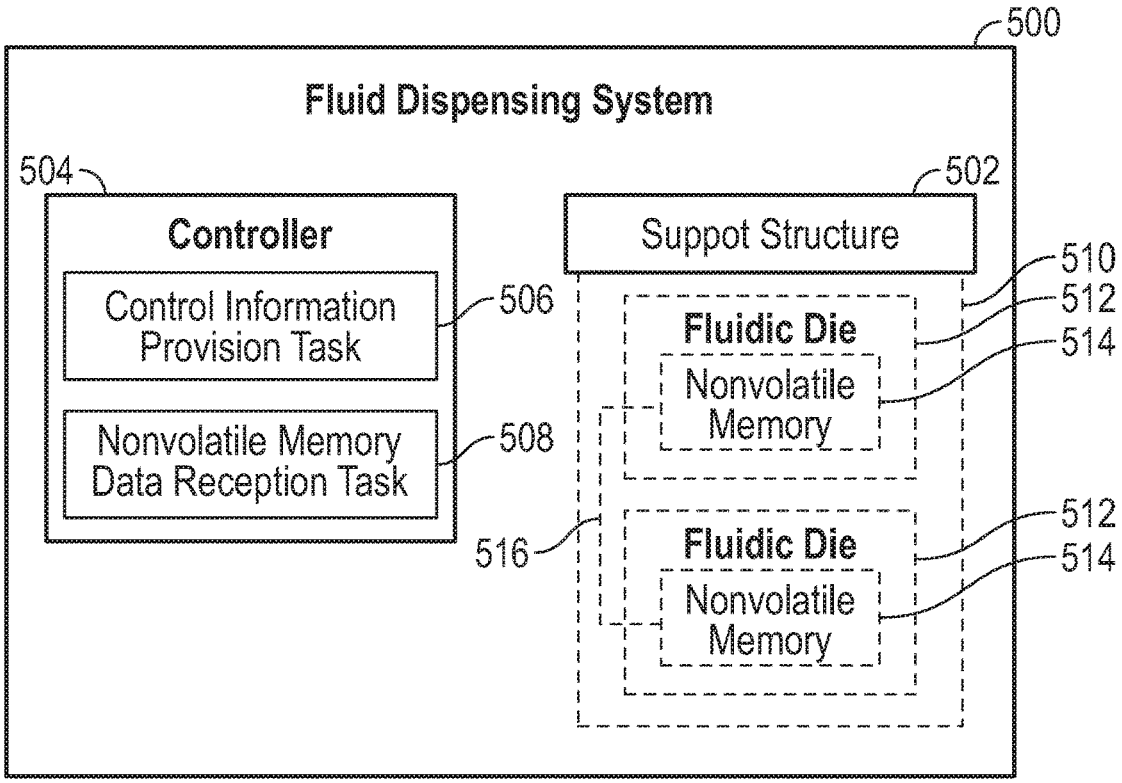
FIG. 5 is a block diagram of a fluid dispensing system according to some examples.

FIG. 5 is a block diagram of a fluid dispensing system 500 that includes a support structure 502 (e.g., the carriage 103 of FIG. 1) to receive a fluid dispensing device 510 having multiple fluidic dies 512 that include nonvolatile memories 514.

The fluid dispensing system 500 includes a controller 504 (e.g., the system controller 110 of FIG. 1) to perform various tasks. The tasks of the controller 504 include a control information provision task 506 to provide control information to respective fluidic dies of the fluid dispensing device using corresponding control inputs of the fluid dispensing device.

The tasks of the controller 504 further include a nonvolatile memory data reception task 508 to receive data from the nonvolatile memories 514 of the fluidic dies 512 over a shared data bus 516 of the fluid dispensing device 510.

Figure 6:
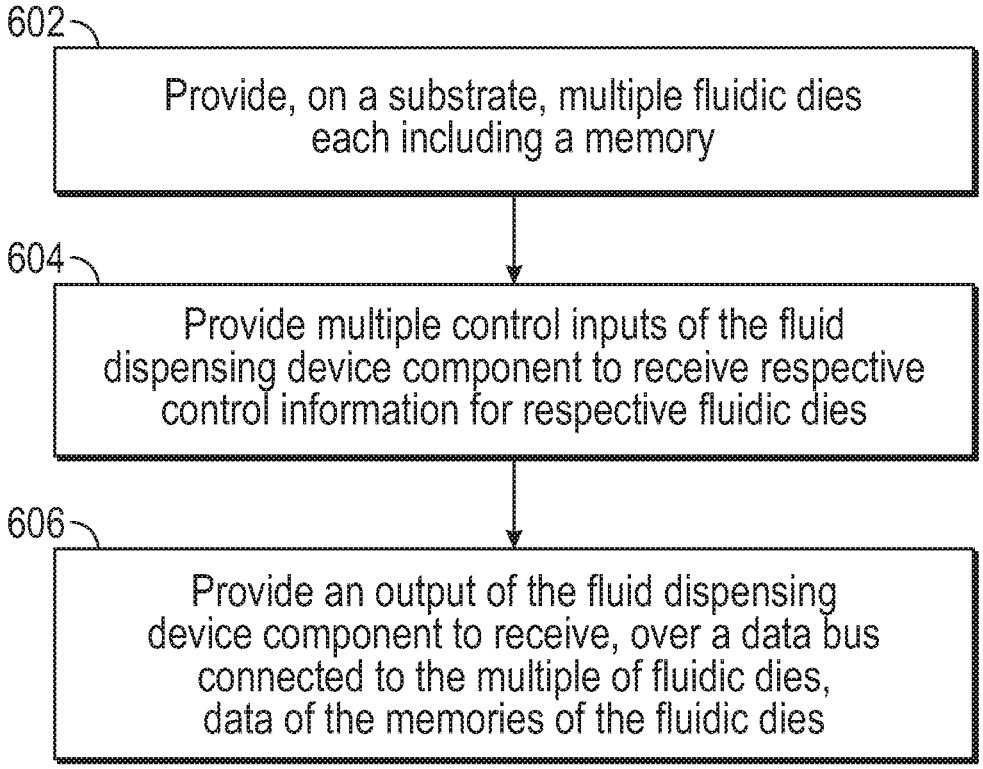
FIG. 6 is a flow diagram of a process according to some examples.

FIG. 6 is a flow diagram of a process of forming a fluid dispensing device component. The process includes providing (at 602), on a substrate, multiple fluidic dies each including a memory. The process includes providing (at 604) multiple control inputs of the fluid dispensing device component to receive respective control information for respective fluidic dies. The process includes providing (at 606) an output of the fluid dispensing device component to receive, over a data bus connected to the plurality of fluidic dies, data of the memories of the fluidic dies.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid dispensing device component comprising:

a plurality of fluidic dies each comprising a memory, wherein each respective memory of a respective fluidic die of the plurality of fluidic dies includes a first portion to store data specific to the respective fluidic die, and a second portion to store common data shared by the plurality of fluidic dies;

a plurality of control inputs to provide respective control information to respective fluidic dies of the plurality of fluidic dies; and a data bus connected to the plurality of fluidic dies, the data bus to provide data of the memories of the plurality of fluidic dies to an output of the fluid dispensing device component.

2. The fluid dispensing device component of claim 1, wherein the plurality of fluidic dies comprise fluidic actuators, and the plurality of control inputs are shared by the fluidic actuators and the memories of the plurality of fluidic dies.

3. The fluid dispensing device component of claim 1, wherein the data bus is to provide the data in analog form to the output of the fluid dispensing device component.

4. The fluid dispensing device component of claim 1, wherein the common data comprises a fluid level of a fluid dispensing device that the fluid dispensing device component is part of or to which the fluid dispensing device component is coupled.

5. The fluid dispensing device component of claim 1, wherein a first control input of the plurality of control inputs is to individually control a first fluidic die of the plurality of fluidic dies, and a second control input of the plurality of control inputs is to individually control a second fluidic die of the plurality of fluidic dies, and wherein the first control input is to provide a data packet containing control information to activate fluidic actuators of the first fluidic die, and the second control input is to provide a data packet containing control information to activate fluidic actuators of the second fluidic die.

6. The fluid dispensing device component of claim 1, further comprising a control signal input shared by the plurality of fluidic dies.

7. The fluid dispensing device component of claim 1, wherein the memory of each of the plurality of fluidic dies comprises a nonvolatile memory.

8. The fluid dispensing device component of claim 1, wherein the common data comprises information of a geographic region where a fluid dispensing device that the fluid dispensing device component is part is to be used.

9. The fluid dispensing device component of claim 1, wherein the common data comprises information of a generation of a fluid dispensing device that the fluid dispensing device component is part of.

10. The fluid dispensing device component of claim 1, wherein the data provided by the data bus comprises the data specific to a first fluidic die of the plurality of fluidic dies, and the common data from the second portion of the memory of the first fluidic die.

11. The fluid dispensing device component of claim 10, wherein the data specific to the first fluidic die comprises a manufacturing date of the first fluidic die or wafer lot information of the first fluidic die.

12. A method of forming a fluid dispensing device component, comprising:

providing, on a substrate, a plurality of fluidic dies each comprising a memory, wherein each respective memory of a respective fluidic die of the plurality of fluidic dies includes a first portion to store data specific to the respective fluidic die, and a second portion to store common data shared by the plurality of fluidic dies;

providing a plurality of control inputs of the fluid dispensing device component to receive respective control information for respective fluidic dies of the plurality of fluidic dies; and providing an output of the fluid dispensing device component to receive, over a data bus connected to the plurality of fluidic dies, data of the memories of the plurality of fluidic dies.

13. The method of claim 12, wherein a first control input of the plurality of control inputs is to receive control information individually for a first fluidic die of the plurality of fluidic dies, and a second control input of the plurality of control inputs is to receive control information individually for a second fluidic die of the plurality of fluidic dies.

14. The method of claim 13, wherein the control information received at the first control input comprises information to control activation of fluidic actuators of the first fluidic die, and the control information received at the second control input comprises information to control activation of fluidic actuators of the second fluidic die.

15. The method of claim 12, further comprising:

providing a control signal input at the fluid dispensing device component, the control signal input shared by the plurality of fluidic dies, wherein the control signal input is to receive at least one selected from among a fire signal input, a clock signal input, and a mode signal input.

16. The method of claim 12, wherein the data provided by the data bus comprises the data specific to a first fluidic die of the plurality of fluidic dies, and the common data from the second portion of the memory of the first fluidic die, and the data specific to the first fluidic die comprises a manufacturing date of the first fluidic die or wafer lot information of the first fluidic die.

* * * * *